US006955999B1

(12) United States Patent
Boye

(10) Patent No.: US 6,955,999 B1
(45) Date of Patent: Oct. 18, 2005

(54) COMPOSITE TEXTILE MATERIAL FOR PROTECTING THE HUMAN BODY AGAINST HEAT

(75) Inventor: Philippe Boye, Sete (FR)

(73) Assignee: Manufacture de Vetements, Sete (FR)

( * ) Notice: Subject to any disclaimer, the term of this patent is extended or adjusted under 35 U.S.C. 154(b) by 0 days.

(21) Appl. No.: 09/367,019

(22) PCT Filed: Feb. 4, 1998

(86) PCT No.: PCT/FR98/00197

§ 371 (c)(1),
(2), (4) Date: Oct. 14, 1999

(87) PCT Pub. No.: WO98/34505

PCT Pub. Date: Aug. 13, 1998

(30) Foreign Application Priority Data

Feb. 6, 1997 (FR) ..... 97 01342

(51) Int. Cl.[7] ..... B32B 5/18; B32B 5/26; D04H 11/00; A41D 13/00

(52) U.S. Cl. ..... 442/205; 442/79; 442/118; 442/239; 442/242; 442/243; 442/244; 442/246; 428/36.1; 428/86; 139/409; 2/455; 2/456; 2/458; 2/2.11; 2/2.14; 2/DIG. 3

(58) Field of Search ..... 428/68, 36.1; 442/61, 442/85, 131, 135, 138, 164, 239, 242, 79, 442/86, 118, 203, 243, 205, 244, 246; 139/409, 139/418, 419; 2/2.11, 2.14, 2.16, 456, 457, 2/DIG. 1, DIG. 3, 458, 455; 46/195, 192, 46/196; 478/86

(56) References Cited

U.S. PATENT DOCUMENTS

| | | | | | |
|---|---|---|---|---|---|
| 2,657,396 | A | * | 11/1953 | Klein et al. | 4/536 |
| 3,536,576 | A | * | 10/1970 | Schwartz | 428/68 |
| 3,575,776 | A | * | 4/1971 | MacIntyre | 428/12 |
| 3,751,727 | A | * | 8/1973 | Shephard et al. | 2/2 |
| 5,399,418 | A | * | 3/1995 | Hartmanns et al. | 442/205 |
| 5,735,145 | A | * | 4/1998 | Pernick | 66/196 |
| 5,774,902 | A | * | 7/1998 | Gehse | 2/458 |
| 6,151,928 | A | * | 11/2000 | Anyon et al. | 66/196 |

* cited by examiner

*Primary Examiner*—Cheryl A. Juska
*Assistant Examiner*—Jenna-Leigh Befumo
(74) *Attorney, Agent, or Firm*—Amster, Rothstein & Ebenstein LLP

(57) ABSTRACT

Composite textile material for protecting the human body against heat, essential comprising an outer zone providing a leakproofing function, an intermediate zone in which a flow of air circulates, and an inner zone allowing mass and heat to be transferred into the intermediate zone, the material being characterized in that it is constituted by a three-dimensional cloth (1, 3, 4) having one fabric (1) of hydrophobic cloth constituting the outer zone, and having its other fabric (4) in the form of a woven cloth or a knit of hydrophilic fibers and constituting the inner zone, the two fabrics (1, 4) being interconnected by link threads (5) enabling the intermediate zone to exist.

16 Claims, 2 Drawing Sheets

FIG_5
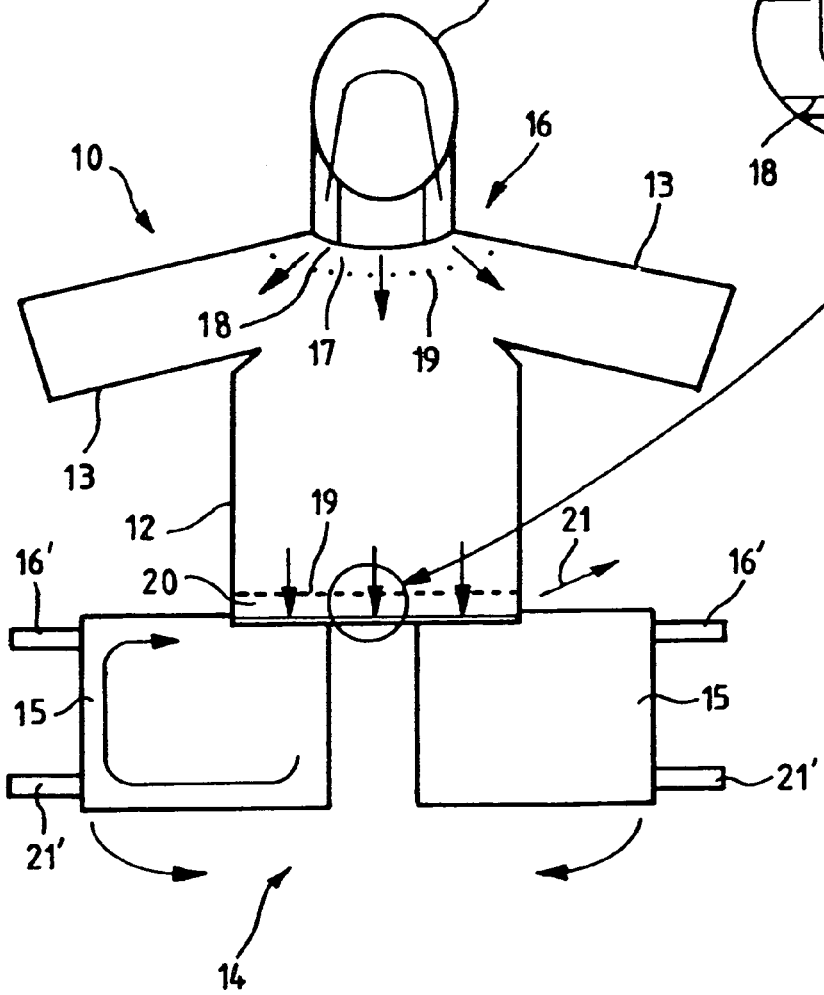
FIG_6
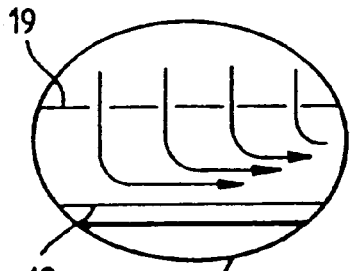
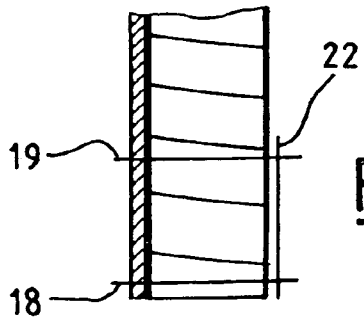
FIG_7

COMPOSITE TEXTILE MATERIAL FOR PROTECTING THE HUMAN BODY AGAINST HEAT

The invention relates to a composite textile material for protecting the human body against heat, in particular for enabling the effectiveness of the ventilation of the surface of the human body to be increased so as to ensure comfort or indeed survival of an individual in an environment that is hot or very hot.

Human body temperature regulation in a hot environment relies essentially on lowering the temperature of the skin by conduction, convection, radiation, and evaporation of sweat, and to a lesser extent by convection and evaporation from the lungs.

When (essentially in terms of temperature and humidity) the existing climate or the micro-climate created close to the body puts a limit on the above-described exchanges to such an extent as to compromise the comfort or even the survival of the individual, there are two methods that can be used:

a) ventilation by means of air that is dry and relatively cool (as much as 4° C. to 5° C. lower in temperature than the skin); and b) contact with a body having high specific heat or high latent heat of transformation, said body having previously been cooled.

The first method is particularly advantageous from three points of view: effectiveness, flexibility of use, and comfort; the second method is generally limited to cases where the environment does not enable a source of air that is dry and relatively cool to be obtained. Nevertheless, even present-day systems based on air ventilation are not entirely satisfactory, firstly because the energy budget can be mediocre in some cases: for example, there is a ratio of 1 to 10 between the useful power and the power delivered when air conditioning an individual in the cabin of a car. Furthermore, non-optimized air consumption in the use of equipment for providing protection against chemical, biological, nuclear, or thermal attack (fireproof outfits) reduces independent working time. The risks of hyperthermia or of the appearance of liquid sweat that can give rise to lesions in the event of exposure to high temperatures make it necessary to use ventilation or air conditioning apparatuses that are relatively heavy or bulky or that limit the length of time an individual wearing such equipment can operate.

It would be advantageous to have a system enabling the efficiency of human body ventilation to be improved, in particular while maintaining specific conditions of temperature and humidity over privileged zones of the human body such as the torso, the arms, the thighs, the scalp, the back, and in any event over an area that is large enough to remove the necessary amount of power as a function of the thermal resistance of the skin, and to do so by means of individual equipment for connecting to external apparatus for ventilation or air conditioning that can be personal or collective, and that operates under moderate conditions. Such moderate conditions consist in particular in providing the individual equipment with air that is dry and cool at a low flow rate, while exhausting air that is moist and warm, with the head loss due to air flow through the individual equipment being very small (e.g. less than 800 Pa). When external conditions make it possible, the natural ventilation generated by the movement of the wearer can suffice, so that forced ventilation is not required.

According to the invention, the problem is solved by using a composite textile material to make the individual equipment, said material essentially comprising:

an outer zone providing a leakproofing function;

an intermediate zone enabling a flow of air to circulate; and an inner zone providing mass and heat transfer from the individual into the intermediate zone.

In the present patent application, the term "outer" designates an element facing either directly or indirectly the environment in which the individual is immersed, while the term "inner" designates an element facing the individual either directly (in contact with the skin) or indirectly (in contact with a garment).

To make such a composite material structure, it is advantageous to use a three-dimensional textile, either on its own or in combination with other textiles.

Three-dimensional textiles are relatively new products and they are constituted by two fabrics united by link threads. In general, the link threads of a three-dimensional textile have properties of size, toughness, or density suitable for enabling them to provide a textile material of thickness that is relatively constant for a given cloth but that can lie, for example, in the range 3 mm to 30 mm, or even more. At present, three-dimensional cloths find applications in the field of protective garments because of their antishock properties or because of the presence of a layer of air in the internal volume thereof (protection against fire).

Given their bending modulus and their density, the link threads of the three-dimensional cloth, e.g. threads made of polyamide, provide good strength against compression in the direction perpendicular to the cloth and make it possible to maintain a circulation of air within the three-dimensional cloth even at possible compression points, and to do so with low head loss. These two characteristics are specific to three-dimensional cloths and are not to be found in foams of the kind conventionally used as padding, e.g. of the polyurethane type. In addition, the link threads pick up liquid sweat and enhance evaporation thereof.

The material of the invention can thus be constituted by a simple three-dimensional cloth made up of two fabrics or cloths that are asymmetrical as to composition, or by a "symmetrical" three-dimensional cloth associated with fabrics or cloths that provide the necessary leakproofing and transfer functions.

The leakproofing function serves mainly to limit leakage of the air flowing in the three-dimensional cloth and is provided by cloth that is optionally coated (e.g. a polyurethane-coated polyester cloth). This cloth can constitute the outer face of the three-dimensional cloth, or it can be a cloth additional to the outer face of the three-dimensional cloth. The leakproofing function must not be completely effective if the cloth is used for making a garment since the outer layer must allow adequate exchange to take place between the body and the environment so that the equipment can be worn when no air is circulating in the intermediate zone.

The transfer function is performed by an inner layer, e.g. a woven cloth or a knit, of fiber of the polyester, polyamide, or polyacetate type or a mixture thereof, that has been treated in hydrophilic manner, and that has good capacity for transferring liquid, good drying capacity, and good permeability to water vapor. The inner layer can constitute the second face of the three-dimensional cloth or it can constitute an element that is separate therefrom. Under such circumstances, it is preferable for the second face of the three-dimensional cloth to have sufficient openings to avoid slowing down heat transfer and mass transfer between the inside of the three-dimensional cloth and the material constituting the inner layer.

Such a textile material is used for example in the form of a garment covering certain portions of the body or in the form of a seat covering or a bed covering, said covering then coming into contact with an individual who may be dressed or otherwise. In both cases, air flow circulation takes place via a diffuser situated downstream from an air admission coupling, and a collector situated upstream of an exhaust coupling. The diffuser and the collector are created in the thickness of the composite textile material by continuous stitching and by non-continuous stitching serving to channel the air flow. Similarly, by means of continuous stitching and non-continuous stitching, it is possible to create preferential paths between the diffuser and the collector for distributing air that is cool and dry so as to cause it to circulate along a preestablished path. A diffuser, a collector, and optionally preferred paths can also be created in similar manner in a seat covering or a bed covering.

The composite textile material and the products made therefrom in accordance with the present invention provide temperature regulation for the comfort or even the survival of an individual in a hot environment, and they are applicable specifically in the following circumstances:

1/ protecting an individual occupying a confined space of the cockpit type, a sleeping bag, or the like, . . .

2/ wearing an outfit that slows down the natural transfer of sweat and of heat from the body to the external environment, while also reducing the ability of an individual to work or survive, where such an outfit serves to provide bullet-proofing, or protection against chemicals, heat, steam, or fire.

In addition to the novel advantages of the present invention, the use of a three-dimensional cloth in certain types of garment or protection continues to provide certain known effects that are advantageous: for bullet-proofing, the material participates in reducing the back effect and can be integrated in the protection itself as an antitrauma layer; and in thermal, steam, or fire protection, it reduces heat transfer by conduction and by convection and can also be integrated in the protection.

The invention is described below in greater detail with reference to the accompanying drawings, in which:

FIG. 5 is a diagrammatic view of a garment made using the composite textile material;

FIG. 6 is a detail of FIG. 5 on a larger scale; and

FIG. 7 is a section view of one type of preferential path created in a material.

Figure 1:
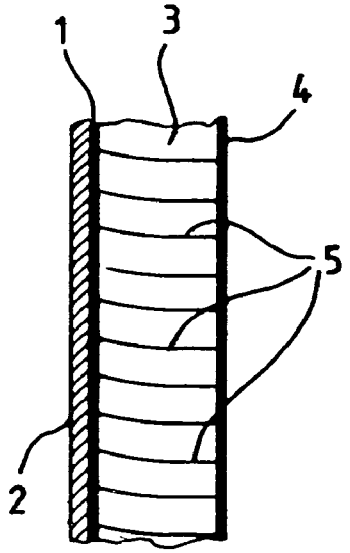
FIG. 1 is a section view of a first embodiment of a composite textile material.

FIG. 1 is a section through a textile material constituted by an outer layer 1, a space 3, and an inner layer 4. The outer layer and the inner layer are interconnected by link threads 5, constituting a so-called "three-dimensional" cloth. The outer layer 1 provides a degree of leakproofing, and is constituted for example by a hydrophobic cloth of the polyester type which can be made totally leakproof if necessary by means of a coating layer 2, e.g. of polyurethane. When it is necessary for leakproofing to be incomplete so as to leave the possibility of interchange under fault conditions (stoppage of the ventilation apparatus), then materials should be used that have composition or structure which provides good permeability to water vapor while offering sufficient head loss between the two faces of the outer layer to limit leakage of air. The inner layer 4 is a woven cloth or a knit of hydrophilic fibers of the polyester, polyamide, or polyacetate type (or a mixture of such fibers)) that has received hydrophilic treatment. This cloth or knit must present good liquid transfer properties, which implies low priming pressure, a high rate of absorption, and a low level of saturation, and it must also have good drying properties, i.e. large surface covering and a high rate of drying, and also good permeability to water vapor.

In the embodiment of FIG. 1, the outer zone is constituted by the layer 1 and possibly by the coating layer 2; the intermediate zone comprises the space 3 through which the link threads 5 pass; and the inner zone is constituted by the cloth 4.

Figure 2:
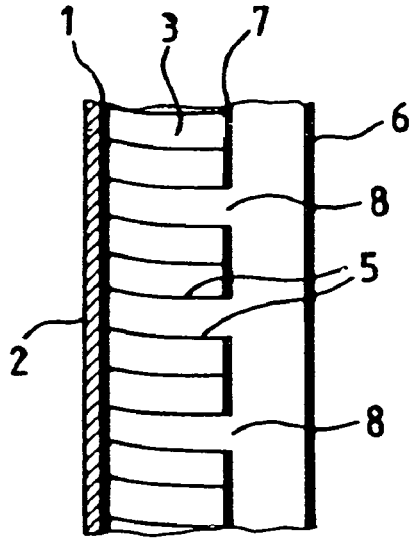
FIG. 2 is a section view of a second embodiment of a composite textile material.

In the example shown in FIG. 2, the outer zone and the intermediate zone have the same structure as in the material of FIG. 1 while the inner zone is defined by a fabric 6 of the same type as the layer 4 in FIG. 1, said fabric 6 being dissociated from the three-dimensional cloth constituted by the outer fabric 1, the space 3, and an additional fabric 7, with link threads interconnecting the fabrics 1 and 7. It can then be advantageous for the fabrics 1 and 7 to be of the same kind so as to simplify manufacture of the three-dimensional cloth. Nevertheless, it is preferable for the structure of the additional fabric to be more open (openings 8) so as to avoid slowing down transfers of heat and mass.

Figure 3:
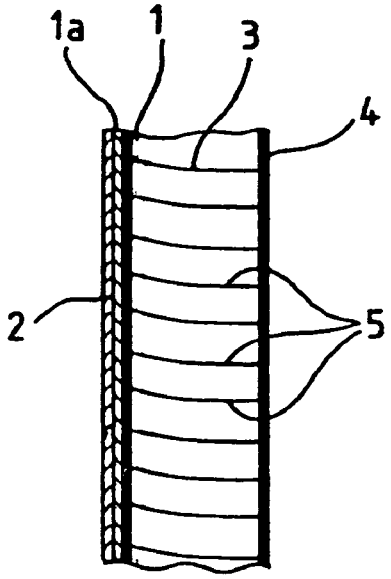
FIG. 3 is a section view of another way of organizing the material.
Figure 4:
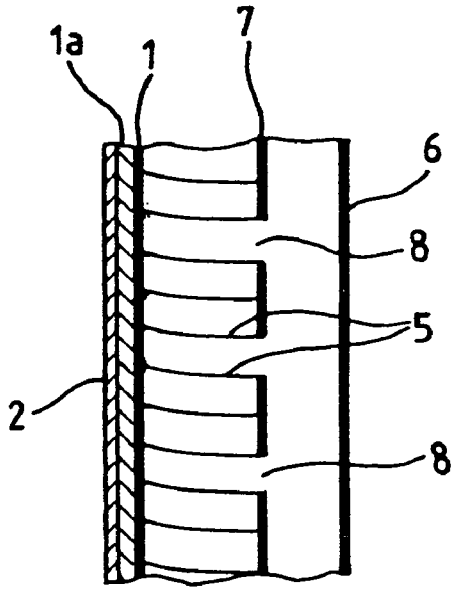
FIG. 4 is a section view of yet another embodiment of the textile material.

The textile materials shown in FIGS. 3 and 4 correspond respectively to those of FIGS. 1 and 2, with the difference that the outer zone is constituted by a fabric 1*a*, optionally having a coating layer 2 and distinct from the fabric constituting the three-dimensional cloth.

FIG. 5 is a diagram of a protective garment made using a textile material of the invention.

By way of example, this garment 10 has a hood 11 connected to a jacket 12 having sleeves 13, and to trousers 14 having legs 15.

A coupling 16 for admitting air that is dry and relatively cool from an external ventilation apparatus (not shown) introduces said air into the space 3 of the textile material via a diffusion zone 17, e.g. situated around the neckline of the garment. This diffusion zone is defined by continuous stitching 18 and by discontinuous stitching 19, the discontinuous stitching enabling diffusion to take place into all of the space 3 (symbolized by arrows). At the bottom of the jacket 12, a collector zone 20 is constituted in the same manner by continuous stitching 18 and by discontinuous stitching 19 with the flow of air that has passed through the jacket being collected and directed (see FIG. 6) towards an exhaust coupling 21 connected to the ventilation apparatus.

A piece of fabric 22 can be added to the inside face of the preferred path (see FIG. 7) to reduce leakage therefrom.

The hood and the legs can be fed with dry and cool air either via the jacket or via diffusion and collection zones that are connected to independent circuits. To this end, the legs can be provided with admission and exhaust couplings 16' and 21', optionally with preferred paths being created by combining continuous stitching and discontinuous stitching.

The textile fabric can also be used for making seat coverings, bunk coverings, sleeping bags, etc., by providing each of these items with respective diffusion and collection zones fitted with admission and exhaust couplings connected to ventilation apparatus.

What is claimed is:

1. A textile fabric article for enclosing and protecting at least a portion of a human body from adverse environmental heat conditions, said textile fabric article constructed from fabric comprising:

a first layer formed of hydrophobic woven material;

a second layer formed of hydrophilic woven material situated generally parallel to and spaced from said first layer, with an intermediate air space defined between said first and second layers;

a plurality of link threads spaced apart from each other, each of said link threads extending generally transverse of said first and second layers and extending generally lengthwise between and connecting and first and second layers; and air circulation means communicating with said intermediate air space.

2. The textile fabric article of claim 1, wherein said textile fabric article is selected from the group consisting of a garment, a seat covering, a bed covering and a sleeping bag.

3. The textile fabric article of claim 1, wherein said circulating means includes an entrance coupling for receiving air to be circulated through said textile fabric article and an exit coupling to permit air to be expelled from said textile fabric article.

4. The textile fabric article of claim 3, further comprising a diffusion zone located intermediate said entrance coupling and said exit coupling for distributing the flow of air to be circulated through said textile fabric article.

5. The textile fabric article of claim 4, wherein said diffusion zone has discontinuous stitching enabling air to diffuse throughout said textile fabric article.

6. The textile fabric article of claim 3, further comprising a collector zone located intermediate said entrance coupling and said exit coupling for collecting the flow of air circulated through said textile fabric article.

7. A textile fabric article for enclosing and protecting at least a portion of a human body from adverse environmental heat conditions, said textile fabric article constructed from fabric comprising:

a first layer formed of hydrophobic woven material;

a second layer formed of hydrophilic woven material situated generally parallel to and spaced from said first layer;

a third layer formed of hydrophilic woven material located between and spaced from both said first and second layers;

a plurality of link threads spaced apart from each other, each of said link threads extending generally transverse of said first and third layers and extending generally lengthwise between and connecting said first and third layers and supporting said third layer in a position intermediate said first and said second layers, thereby defining a continuous first air space between said second and third layer and a discontinuous second air space interrupted by said plurality of link threads between said first and third layers; and air circulation means communicating with said first and second air spaces.

8. The textile fabric article of claim 7, wherein said second layer of hydrophilic woven material is discontinuous, allowing air to diffuse therethrough.

9. The textile fabric article of claim 8, wherein said textile fabric article is selected from the group consisting of a garment, a seat covering, a bed covering and a sleeping bag.

10. The textile fabric article of claim 8, wherein the circulating means includes an entrance coupling for receiving air to be circulated through the system and an exit coupling to permit air to be expelled from said textile fabric article.

11. The textile fabric article of claim 10, further comprising a diffusion zone located intermediate said entrance coupling and said exit coupling for distributing the flow of air to be circulated through said textile fabric article.

12. The textile fabric article of claim 11, wherein said diffusion zone has discontinuous stitching enabling air to diffuse throughout said entire textile fabric article.

13. The textile fabric article of claim 12 further comprising a collector zone located intermediate said entrance coupling and said exit coupling for collecting the flow of air circulated through said textile fabric article.

14. A textile fabric article in the form of a garment for enclosing and protecting at least a portion of a human body from adverse environmental heat conditions, said article constructed from fabric comprising:

a first layer formed of hydrophobic woven material;

a second layer formed of hydrophilic woven material situated generally parallel to and spaced from said first layer;

a third layer formed of hydrophilic woven material located between and spaced from both said first and second layers;

a plurality of link threads spaced apart from each other, each of said link threads extending generally transverse of said first and third layers and extending generally lengthwise between and connecting said first and third layers and supporting said third layer in a position intermediate said first and said second layers, thereby defining a continuous first air space between said second and third layer and a discontinuous second air space interrupted by said plurality of link threads between said first and third layers; and air circulation means communicating with said first and second air spaces.

15. A textile fabric article in the form of a garment for enclosing and protecting at least a portion of a human body from adverse environmental heat conditions, said textile fabric article constructed from fabric comprising:

a first layer formed of hydrophobic woven material;

a second layer formed of hydrophilic woven material situated generally parallel to and spaced from said first layer, with an intermediate air space defined between said first and second layers;

a plurality of link threads spaced apart from each other, each of said link threads extending generally transverse of said first and second layers and extending generally lengthwise between and connecting said first and second layers;

air circulation means communicating with said intermediate air space, wherein said circulating means includes an entrance coupling for receiving air to be circulated through said textile fabric article and an exit coupling to permit air to be expelled from said textile fabric article; and a diffusion zone located intermediate said entrance coupling and said exit coupling for distributing the flow of air to be circulated through said textile fabric article, wherein said diffusion zone has discontinuous stitching enabling air to diffuse throughout said textile fabric article.

16. A textile fabric article in the form of a garment for enclosing and protecting at least a portion of a human body from adverse environmental heat conditions, said textile fabric article constructed from fabric comprising:

a first layer formed of hydrophobic woven material;

a second layer formed of hydrophilic woven material situated generally parallel to and spaced from said first layer, said second layer of hydrophilic woven material being discontinuous, allowing air to diffuse there-through;

a third layer formed of hydrophilic woven material located between and spaced from both said first and second layers;

a plurality of link threads spaced apart from each other, each of said link threads extending generally transverse of said first and third layers and extending generally lengthwise between and connecting said first and third layers and supporting said third layer in a position intermediate said first and said second layers, thereby defining a continuous first air space between said second and third layer and a discontinuous second air space interrupted by said plurality of link threads between said first and third layers; and air circulation means communicating with said first and second air spaces.

* * * * *